United States Patent [19]

Cavagna et al.

[11] Patent Number: 4,898,752

[45] Date of Patent: Feb. 6, 1990

[54] METHOD FOR MAKING COATED AND PRINTED PACKAGING MATERIAL ON A PRINTING PRESS

[75] Inventors: Giancarlo A. Cavagna, Silver Spring, Md.; Ernest J. Groome, Charleston, S.C.; Joseph M. Murphy, Springfield, Mass.; Domenick L. Raschella, Midlothian, Va.

[73] Assignee: Westvaco Corporation, New York, N.Y.

[21] Appl. No.: 175,249

[22] Filed: Mar. 30, 1988

[51] Int. Cl.[4] ..... B05D 3/02; B05D 3/12; B05D 5/00; B05D 7/00

[52] U.S. Cl. ..... 427/265; 427/258; 427/288; 427/428

[58] Field of Search ..... 427/258, 261, 265, 288, 427/428

[56] References Cited

U.S. PATENT DOCUMENTS 2,746,878 5/1956 Rush ..... 427/288 X

FOREIGN PATENT DOCUMENTS 471338 9/1937 United Kingdom ..... 427/261

*Primary Examiner*—Evan Lawrence

[57] ABSTRACT

Unbleached paper and paperboard for use as outer packaging material is coated and printed on a printing press. The unbleached rawstock must be relatively smooth and nonporous prior to coating and printing with a Sheffield roughness less than about 300 units for linerboard and less than about 330 units for folding carton material. The coating formulation preferably comprises a mixture of temperature insensitive binders and pigments having a viscosity lower than normal paper coatings, and is applied in layers of about 1.5 lb./1000 square feet up to a total of about 5 lb./1000 square feet. Best results are obtained when the coated surface is doctored with a blade or fixed roll after coating and before drying to achieve a smooth surface for printing on the same or a different press.

7 Claims, 2 Drawing Sheets

METHOD FOR MAKING COATED AND PRINTED PACKAGING MATERIAL ON A PRINTING PRESS

BACKGROUND OF THE INVENTION

The present invention relates to the production of outer packaging material and more particularly to the production of such packaging material finished on a printing press.

Outer packaging material is generally understood in the industry to comprise wrappers, carriers and the like for primary containers such as bottles or cans. Most outer packaging material is made of paper, or paperboard, typically referred to as folding carton material or corrugated paperboard. Unbleached paperboard is specifically manufactured to be used for outer container packaging. High strength is desired, so the board is usually produced from strong fiber and contains chemical additives to resist moisture. After the board is made, it has been the custom in the industry to finish at least one surface with a white coating or the like, to permit printing of the naturally brown, rough surface of the unbleached board. One method has been to coat one surface of the board in an on or off machine coating process with a coating composition comprising latex, clay and titanium dioxide. In other cases, an outer thin layer of high-quality label paper or a plastic film have been laminated to one surface of the unbleached paperboard to provide a printable surface.

Containers of two types employ white surfaced (clay coated) unbleached kraft board. The first type are corrugated packages. In the manufacture of white top corrugated packages, the outer surface of a sheet of linerboard (for example, about 30–65 lbs./1000 square feet basis weight) is clay coated at the paper mill, preprinted in web form by flexography with high quality graphics, then used as the outer liner in the corrugating process before being converted into boxes. The second type are single ply folding cartons such as beverage carriers. For these packages, the unbleached paperboard (for example, about 40–100 lbs./1000 square feet basis weight) is coated at the paper mill, printed by gravure, die-cut and converted directly into boxes. The board used for the second type of packages needs to be heavier and stiffer than the board used in the first type. At the present time the heavier weight clay coated board is in short supply and thus is expensive. Meanwhile the lighter weight coated linerboard for corrugated boxes is no longer extensively made in the United States since it requires specialized facilities for its production which generally aren't available at a kraft mill. For this reason, more and more users have switched to the more expensive laminated products using plastic films and label paper.

SUMMARY OF THE INVENTION

According to the present invention, a process has been developed for producing white top paperboard for outer packaging material on a printing press. In the process, coated board is produced on a printing press by taking an unbleached and uncoated kraft rawstock and coating it by printing one or more coating layers on one surface, and subsequently printing the coated surface on the same or a different press. The process may be carried out using either flexographic or gravure presses. The result is a coated and printed surface comparable to a paper mill coated product having good smoothness and brightness without scratches. The invention is dependent on several elements including the condition of the board surface before coating, the coating formulation, the press arrangement and the coating application.

The first step involves the selection of an unbleached board for coating and printing on a press. The selection is made on the basis of the board surface whether the final product is linerboard for corrugated products, or folding carton stock for single ply bottle carriers or the like. In either case, the board surface must be smooth, well sealed and strong. Good formation is essential, and a highly sized board surface is preferred to hold the coating on the surface. The surface of the board should have a Sheffield roughness of 300 units or less for linerboard and 330 units or less for folding carton material. These values contrast with normal values of greater than 350 and 400 respectively for regular linerboard and folding carton stock. Likewise, the degree to which the board surface is sealed, measured by air permeability, is important. Board satisfactory for the present invention should have a value higher than 30 seconds according to the Gurley Porosity test. These characteristics may be achieved on the papermachine by one of several techniques. One method is to ensure that 85% or more of the hardwood fibers in the furnish end up on the board surface. When the surface furnish is applied with a secondary headbox, the surface furnish should be highly refined to 350–400 seconds Williams freeness at a pH greater than 7. In addition, some means such as the use of cleaners may be necessary to remove shives and sand from the surface. The board so formed must then be calendered to achieve the Sheffield roughness values specified hereinbefore. Board not meeting these standards will result in unacceptable coated and printed properties such as roughness, uneveness and lack of gloss.

The second step in the present invention involves the proper selection of press settings and press elements to apply the coatings. In a flexography press, the anilox roll should preferably be a laser engraved roll having a close packed (30 degree) cell arrangement for the most uniform coating application. The depth of the cells should not exceed 100 microns $\mu$ m). An engraved roll having a screen size of from about 120–360 lines per inch is preferred. The printing blanket for flexography is preferably prepared from a rubber material having a Shore A hardness of 55 or less. A higher hardness could result in lower coat weights and photopolymer plates could result in a mottled printed surface. Meanwhile, in a gravure printing application, indirect gravure printing is preferred with the engraved roll and printing blanket having the same characteristics as in flexography.

The third important step in the present invention lies in the formulation of the coating material. An ordinary coating formulation typically used in the paper mill for paper or board will not perform when applied on a printing press because its resistance to flow and leveling is excessive. The use of an ordinary paper coating on the press will result in bare spots or skipped areas. The performance of the coating formulation for a press may be controlled by binder selection, binder-to-pigment ratio and type of pigment used. Binder selection is critical. Since there is no way to control the temperature of a coating on a printing press, the rheology changes with temperature. Accordingly, a temperature sensitive binder such as starch cannot be used in a coating applied on a press. A synthetic latex is preferred. For example, polyvinylacetate (PVAc), styrene butadiene (SBR), and acrylics can be used alone or in combination. A preferred mixture would be a 70/30 ratio of PVAc/SBR. Likewise, low levels of binders in the range of 16 parts binder/100 parts pigment as used in conventional paper coatings are unacceptable because they lead to higher resistance to flow. A higher ratio on the order of about 20–25 parts binder/100 parts pigment is preferred. In addition, clay, titanium dioxide and calcium carbonate may also be used as coating pigments in the present invention depending on the brightness level required. Mixtures of these pigments including titanium dioxide are useful for the high opacity needed to cover the unbleached board surface. Additives to control and improve coating flow and leveling may also be used. Calcium stearate, glycols and water soluble low molecular weight polymers are examples. Their concentration usually does not exceed about 5% by weight. It is also not necessary to control the pH of coatings used in the present invention unlike conventional papermaking coatings applied on a papermachine which require pH control The preferred viscosity of the coating used in the present invention is between about 7 and 11 seconds as measured with a Number 3 Zahn cup.

One or more coating applications may be applied to the rawstock prior to printing The number of applications depends on the properties desired and the number of printing stations available. For best smoothness, the coat weight applied in each application should be about 1–1.5 lbs/1000 square feet. The factors controlling the final properties most relevant to printing are coat weight and brightness (i.e., concentration of bright pigments). For example, sufficient smoothness and ink holdout for gloss can be achieved with a total coat weight of about 2 lbs./1000 square feet if the final printed surface does not contain white areas, or only very unobtrusive white areas. On the other hand, if a high brightness (TAPPI Brightness 78–80) is required, a coat weight of 4 or more lbs/1000 square feet may be needed with a high concentration (40–50%) of titanium dioxide. After coating on the press, it has also been found feasible to apply a white pigmented ink to the printing surface with great success. Finally, the process of the present invention does not require any modification to the printing press. With careful selection of a substrate having optimum smoothness, appropriate selection of the press characteristics and a coating formulation tailored for the desired end use, a successful white surfaced product can be produced for use as outer packaging material.

It is, therefore, an object of the present invention to produce a coated paperboard product on a printing press suitable for printing on the same or a different press with high quality graphics. The purpose of the present invention is to upgrade at least one surface of an otherwise inexpensive, unbleached, paperboard material to a more costly, desireable, well sealed, uniform and smooth surface of high brightness, adapted to receive high quality graphics using any printing method.

DETAILED DESCRIPTION

Figure 1A:
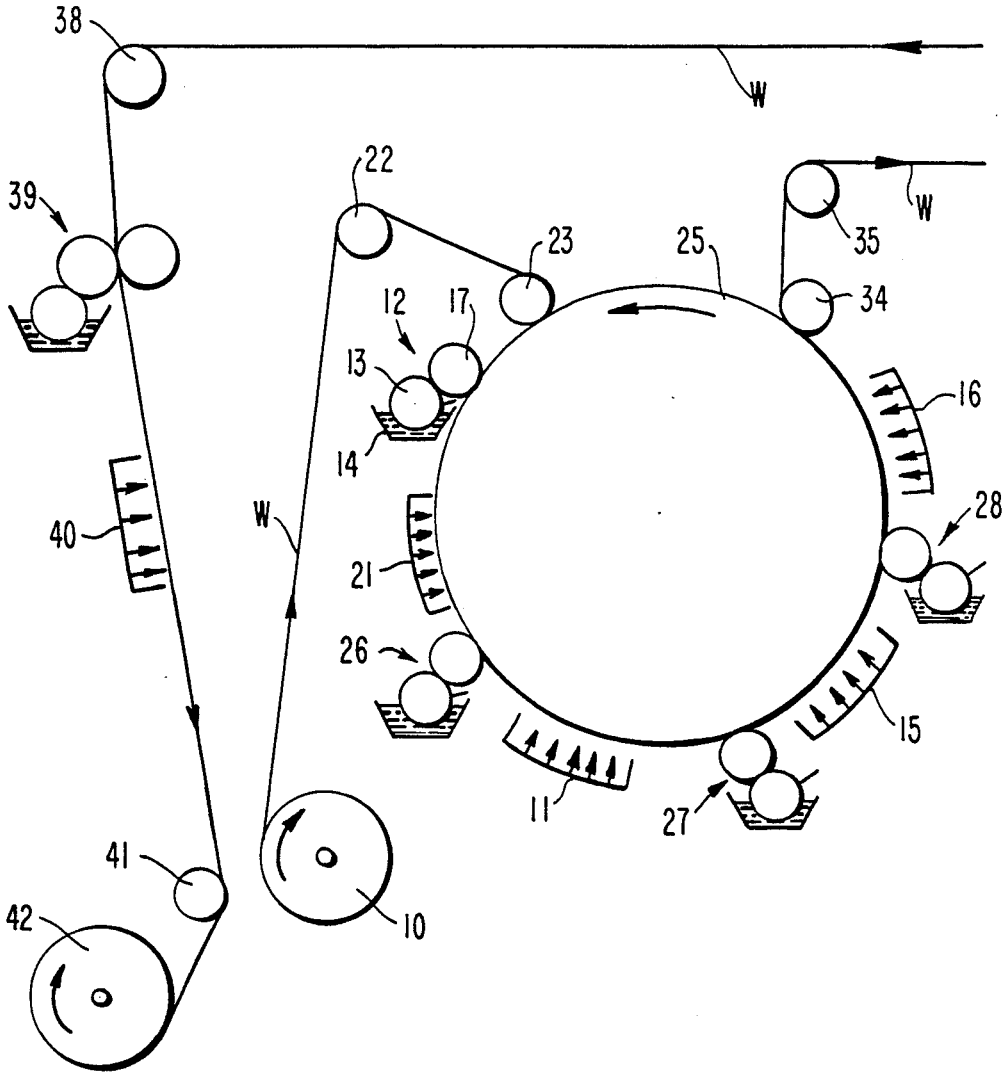
FIG. 1(A) shows schematically a first part of a typical printing apparatus useful for the present invention.

In a typical operation, the method of the present invention may be carried out on any type of printing press with flexo or gravure presses being preferred. An example of a typical flexography press for use with the present invention comprises a plurality of flexo stations arranged around one or more large diameter impression rolls. Drying units are placed around the impression rolls between flexo stations, and a varnish station is added prior to the rewind stand. Space may be made available after each flexo station used for coating for mounting a doctor blade to smooth the coated surface after application of the coating and before drying.

An example of a typical gravure press for use with the present invention comprises two or more gravure printing stations one after the other on a single press. Printing a coating by direct gravure does not produce a satisfactory product. Thus, the press should be converted to indirect gravure for the coating application.

In the illustrative, diagrammatic showing of FIG. 1 (A) and 1(B), a web W of packaging material which may comprise heavy weight paperboard or linerboard is supplied from a roll 10 for coating and printing on a flexographic type printing press. The web W passes around a first guide roll 22 and a second guide roll 23 before entering into the nip of a first flexo printing station generally designated by the reference numeral 12 where a first application of the coating formulation of the present invention may be applied. A typical flexo station 12 comprises an anilox roll 13 positioned to rotate within a coating pan 14. The portion of roll 13 immersed in the coating picks up coating for delivery to the applicator roll 17. The anilox roll 13 has a textured surface, the characteristics of which regulate the amount of coating picked up from the coating pan 14. Typical of anilox rolls useful in the present invention are chrome plated rolls ranging in screen size from about 120 to 360 lines per inch, with the smaller numbers representing the larger volumes. Coating material retained within the textured surface of the anilox roll 13 is subsequently transferred to the applicator roll 17. For a typical flexo printing operation, the applicator roll 17 carries the image pattern desired to be transferred to the web W. However, in the present invention, the applicator roll 17 is smooth for providing a first coating application to the web. Backing roll 25 provides a suitable backing surface for nip confinement of the web W with the applicator roll 17. Subsequent to the application of the coating to the web W, a smoothening blade 20 may be used to smoothen the coated surface as shown in FIG. 2 prior to entering the drying unit 21. The blade 20 is preferably arranged at an angle of about 90 degrees with respect to the web W for best results.

Figure 1B:
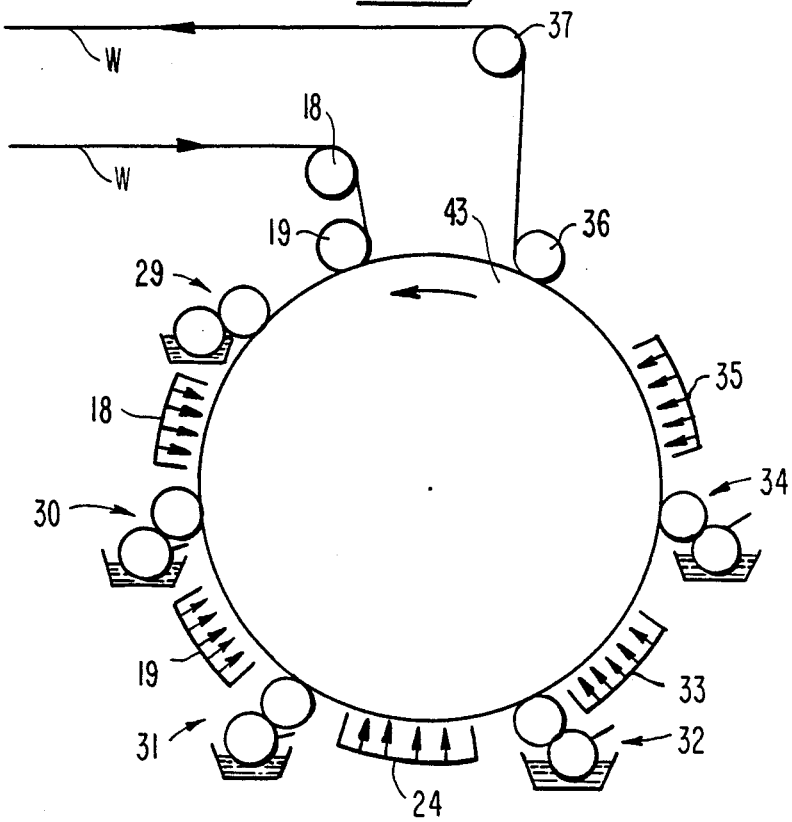
FIG. 1(B) shows schematically the second part of the apparatus of FIG. 1(A); and, FIG. 2 is a partial schematic view of FIG. 1(A) showing a modification for the first printing station.
Figure 2:
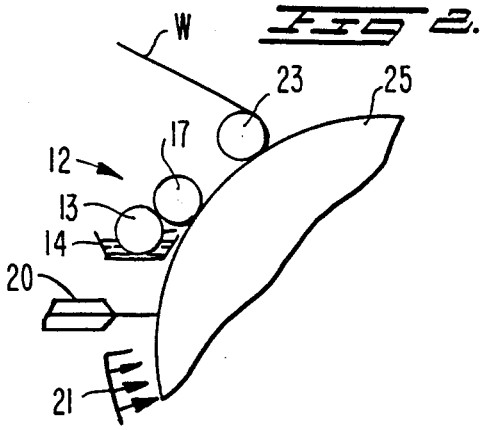

After drying unit 21, the coated web continues to pass around backing roll 25 Additional flexo printing stations may be added in conjunction with backing roll 25 with three (3) additional units 26–28 shown in FIG. 1(A). Following these additional printing units, it is necessary to add additional drying units generally shown by the reference characters 11, 15 and 16. The additional flexo stations may be used to apply additional coating layers or for more conventional printing steps. After passing under drying unit 16, the web W may be conducted to another backing roll for printing additional colors. For this purpose, the web W passes around idler rolls 34 and 35 and continues around idler rolls 18 and 19 into contact with the second backing roll 43 as shown in FIG. 1(B). Five (5) additional flexo printing stations identified by reference characters 29–32 and 34 are arranged around backing roll 43. Drying units identified by reference characters 18, 19, 24, 33 and 35 are arranged around backing roll 43 after each printing station. Finally the web W passes around idler rolls 36 and 37 and is conducted back to FIG. 1(A) around idler roll 38 before entering varnish station 39 and drying unit 40. From this point, the web W passes around idler roll 41 before ending up in final printed form as roll 42. Thus it may be seen that the method of the present invention may be carried out, on a typical flexographic press without modification except for the construction of the image blankets (applicator rolls) at each printing station used for coating applications. This same concept holds true whether the press is of the flexographic or gravure type. Accordingly the present invention obviates the need for costly coating equipment on machine, or a separate coating application.

Press coating trials using flexography and gravure presses were conducted. I. the first trial, samples of KRAFTPAK paperboard and PRINTKRAFT linerboard, products of Westvaco Corporation, were coated and printed on a flexographic press. Two coating formulations were applied, including a formulation with all polyvinylacetate latex binder and a formulation with a mixed polyvinylacetate/styrene butadiene binder system. In addition, calcium stearate was added in some cases to improve the leveling ability of the coating. The first coating formulation was applied with both a soft photopolymer printing plate and a rubber printing plate. Formulation number two was applied only with a rubber plate. The KRAFTPAK paperboard control had a highly calendered, nearly all hardwood refined secondary surface with a Sheffield roughness of 330 units. The PRINTKRAFT control had a lower than average Sheffield roughness on the order of about 230 units.

Each pass through the press with the first coating formulation resulted in the application of close to one pound of coating per 1000 square feet of paper. Formulation number two gave slightly higher coat weights per pass. A comparison of the Sheffield and Printsurf values of the coated samples showed that the rubber printing blanket was superior to a photopolymer blanket of similar hardness and wettability in achieving smoothness. The test with calcium stearate was carried out on PRINTKRAFT linerboard. The addition of calcium stearate to the coating at a rate of only about 1% based on solids improved smoothness 15 units as measured by Sheffield. The brightness of the coated products was proportional to the coat weight as expected. Meanwhile the spreading and leveling of the coating formulations was not uniform at solids higher than about 57%.

Printing tests of the coated products consisted of one application of a single coat of a high brightness white ink, one coat of a transparent sealer over the white ink, and an overprint of a halftone blue image. The printed product was over varnished as is customary with packaging material. The printing evaluation was based on image quality, brightness of the coated areas, and a subjective comparison of how close the press coating method of the present invention could come to the print quality achieved with commercial clay coated board. From these evaluations it was concluded that the second coating formulation (mixed binder) was superior to formulation number one, and that the rubber printing blanket was superior to the photopolymer blanket. There was a positive correlation between print quality and the smoothness of the coated layer. Higher smoothness resulted in fewer missing dots in the halftone printed image and in higher print quality overall.

In a trial using a gravure printing press, it was found that the use of a direct gravure process to print the coating produced an undesireable split pattern. However, conversion from a direct gravure process to an indirect gravure arrangement substantially eliminated the split pattern and produced a better product. The coat weight range for both the indirect gravure arrangement and the direct gravure process was in the range 1.1 to 2.1 lbs./1000 square feet of paper.

In the indirect gravure set up, the engraved roll picked up coating from the coating pan. The roll was scraped with a doctor blade to meter the coating, which was then transferred to a rubber printing roll. This roll in turn applied the coating to the paperboard samples in a nip against another hard rubber backing roll. The engraved and transfer rolls turned at the same speed as the web during most tests, but speed differentials of up to 20% could be tolerated.

In the direct gravure set up, the engraved roll picked up coating from a coating pan, was doctored by a blade, and then transferred directly to the web moving at the same speed. After the coating nip, a smoothening rod of about 0.5 inch in diameter was positioned to bear against the coated surface and smoothen it. A single binder (polyvinylacetate) coating formulation was used at 56.8% solids to apply the coating to regular 42 lbs./1000 square feet basis weight linerboard. In each case, a smooth product was produced suitable for printing.

It will thus be seen that the present invention comprises a combination coating and printing process carried out on a printing press. The process is designed to upgrade the quality of unbleached paper and paperboard for use as packaging material. Although the process has been described somewhat specifically, it is to be understood that various modifications and alterations may be made in the present invention without departing from the spirit and scope of the appended claims.

What is claimed is:

1. The process of manufacturing outer packaging material on a web fed printing press having a plurality of printing stations comprising the steps of:

(a) selecting a web of unbleached paper board having surfaces that are smooth, well sealed and strong;

(b) feeding said web to a printing press having a plurality of printing stations;

(c) applying a coating formulation comprising temperature insensitive binders selected from the group consisting of polyvinylacetate, styrene butadiene and acrylics, and mixtures thereof, and pigments selected from the group consisting of clay, titanium dioxide and calcium carbonate, and mixtures thereof, having a binder-to-pigment ratio of from about 20–25 parts binder to 100 parts pigment, a viscosity of from about 7–11 seconds measured by a No. 3 Zahn cup, and a solids content of between about 50–60% to at least one surface of said web at selected printing stations on said press in increments of about 1–1.5 lbs./1000 square feed to achieve a total coat weight of at least about 2 lbs./1000 square feet;

(d) drying said coated surface after each coating application; and (e) printing high quality graphics on the coated surface of said web at subsequent printing stations on said printing press.

2. The process of claim 1 wherein the printing press has an anilox roll at each printing station where coating is applied with a screen size of from about 120 to 360 lines per inch and a rubber printing blanket with a shore A hardness of about 55 units or less.

3. The process of claim 2 wherein the coated surface of said web is doctored after each coating application.

4. The process of claim 1 wherein the printing press has a gravure roll at each printing station where coating is applied and a rubber printing blanket with a Shore A hardness of about 55 units or less, and the coated surface of said web is doctored after each coating application.

5. The process of claim 3 wherein the unbleached paperboard web is linerboard having a basis weight of from about 30–65 lbs./1000 square feet, a Sheffield roughness of about 300 units or less, and a Gurley porosity of at least about 30 seconds.

6. The process of claim 3 wherein the unbleached paperboard web is folding carton material having a basis weight of from about 40–100 lbs./1000 square feet, a Sheffield roughness of about 330 units or less, and Gurley porosity of at least about 30 seconds.

7. A process for manufacturing outer packaging material on a printing press comprising:

(a) selecting a web of unbleached rawstock having a Sheffield roughness of about 330 units or less and a Gurley porosity of at least about 30 seconds;

(b) feeding said web to a printing press having a plurality of printing stations;

(c) applying a coating formulation comprising temperature insensitive binders and pigments having a binder-to-pigment ratio of from about 20–25 parts binder to 100 parts pigment, said binders being selected from the group consisting of polyvinylacetate, styrene butadiene and acrylics, and mixtures thereof, and said pigments being selected from the group consisting of clay, titanium dioxide and calcium carbonate, and mixtures thereof, a viscosity of from about 7–11 seconds as measured by a No. 3 Zahn cup, and a solids content of between about 50–60% by weight to at least one surface of said web in increments of about 1–1.5 lbs/1000 square feet at selected printing stations to achieve a total coat weight of about 4–6 lbs/1000 square feet and thereby cover the unbleached surface of said web;

(d) smoothening said coated surface after each coating application with a fixed doctor blade arranged at an angle of about 90 degrees with respect to the web;

(e) drying said coated surface after each coating application; and (f) printing said coated surface with high quality graphics at subsequent printing stations on said printing press.

* * * * *